US007296794B2

(12) United States Patent
Shimazaki

(10) Patent No.: US 7,296,794 B2
(45) Date of Patent: Nov. 20, 2007

(54) IMAGE FORMING APPARATUS

(75) Inventor: Takahisa Shimazaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 400 days.

(21) Appl. No.: 11/029,276

(22) Filed: Jan. 5, 2005

(65) Prior Publication Data

US 2005/0151313 A1 Jul. 14, 2005

(30) Foreign Application Priority Data

Jan. 14, 2004 (JP) ..... 2004-006532

(51) Int. Cl.
*B65H 7/02* (2006.01)

(52) U.S. Cl. ..... 271/259; 271/10.03

(58) Field of Classification Search ..... 271/4.02, 271/4.03, 10.02, 10.03, 259, 265.02
See application file for complete search history.

(56) References Cited

U.S. PATENT DOCUMENTS 4,077,620 A * 3/1978 Frank et al. ..... 271/10.03
4,740,193 A * 4/1988 Frost et al. ..... 493/82
4,893,804 A * 1/1990 Sasage et al. ..... 271/3.09
5,056,771 A * 10/1991 Beck et al. ..... 271/114
5,211,387 A * 5/1993 Lloyd et al. ..... 271/111
5,423,527 A * 6/1995 Tranquilla ..... 271/10.02
5,692,742 A * 12/1997 Tranquilla ..... 271/10.03
5,964,460 A * 10/1999 Azumi et al. ..... 271/265.01
6,076,821 A * 6/2000 Embry et al. ..... 271/10.01
6,439,563 B1 * 8/2002 Kayani ..... 271/10.03
6,533,264 B1 * 3/2003 Tranquilla ..... 271/10.02
6,554,275 B1 * 4/2003 Tranquilla ..... 271/259
6,572,103 B1 * 6/2003 Tranquilla ..... 271/265.02
6,595,510 B2 * 7/2003 Kayani ..... 271/10.03
6,702,274 B1 * 3/2004 Otsuka ..... 271/10.01
6,978,992 B2 * 12/2005 Otsuka ..... 271/10.01

FOREIGN PATENT DOCUMENTS

JP 05-193782 A 8/1993

* cited by examiner

*Primary Examiner*—Patrick Mackey
*Assistant Examiner*—Michael C McCullough
(74) *Attorney, Agent, or Firm*—Akin Gump Strauss Hauer & Feld LLP

(57) ABSTRACT

An image forming apparatus includes a sheet sensor (7) and a leading end position sensor (9). The sheet sensor (7) detects the passage of a trailing end of a printing sheet (10) along a feeding path of the printing sheet (10) fed by a first feeding roller (2) from a sheet storing portion (1). The leading end position sensor (9) detects a protruding amount of the subsequent printing sheet ($\mathbf{10}_2$) when the preceding printing sheet ($\mathbf{10}_1$) is fed by the first feeding roller (2). The feeding of the subsequent printing sheet ($\mathbf{10}_2$) is started when an adjusting time has elapsed after the sheet sensor (7) detects the passage of the preceding printing sheet ($\mathbf{10}_1$). The adjusting time is determined according to the protruding amount of the subsequent printing sheet ($\mathbf{10}_2$) detected by the leading end position sensor (9).

10 Claims, 10 Drawing Sheets

IMAGE FORMING APPARATUS

BACKGROUND OF THE INVENTION

This invention relates to an image forming apparatus such as a printer, a facsimile or a copier, and particularly relates to an image forming apparatus having a sheet feeding device capable of continuously feeding printing sheets.

In order to feed printing sheets at constant intervals, a conventional image forming apparatus has a sheet sensor on a sheet feeding path from a sheet storing portion to a photosensitive drum. A separating member lifts a trailing end of a preceding sheet so that the trailing end moves out of a detectable area of the sheet sensor, while the sheet sensor is used to position a leading end of a subsequent printing sheet. After the positioning of the leading end of the subsequent printing sheet is completed, the separating member moves the trailing end of the preceding sheet downward, so that a constant spatial interval is formed between the preceding sheet and the subsequent sheet. An example of such an image forming apparatus is disclosed in Japanese Laid-Open Patent Publication No. 5-193782 (in particular, Page 1 and FIG. 1).

However, in the above described image forming apparatus, it is necessary that the printing sheet warps with a suitable balance when the separating member lifts the printing sheet. Thus, the separating member needs to have a member that acts on the printing sheet uniformly throughout the width of the printing sheet, and therefore the size of the sheet feeding device may increase. Moreover, it is necessary to control the movement of the separating member in addition to a general sheet feeding device, and therefore the controlling of the sheet feeding device may become complicated.

SUMMARY OF THE INVENTION

An object of the present invention is to provide an image forming apparatus capable of feeding printing sheets so that constant spatial intervals are formed therebetween, without requiring significant change to a general image forming apparatus, and without requiring a complicated controlling system.

The present invention provides an image forming apparatus including a storing portion in which a plurality of printing media are stored, a first feeding unit capable of feeding one printing medium after another from the printing media stored in the storing portion to the outside of the storing portion, a second feeding unit that feeds the printing medium (having been fed by the first feeding unit) along a predetermined feeding path, a timing detection unit that detects a timing when the printing medium reaches a predetermined position along the feeding path, a protruding amount detection unit that detects a protruding amount of a subsequent printing medium protruding from the storing portion when the second feeding unit feeds a preceding printing medium prior to the subsequent printing medium, and a feeding control unit that determines a timing of starting the feeding of the subsequent printing medium according to a timing detected by the timing detection unit and the protruding amount detected by the protruding amount detection unit.

With such an arrangement, it becomes possible to accomplish an image forming apparatus capable of successively feeding a plurality of printing media at constant spatial intervals. Moreover, the image forming apparatus can be accomplished by making a relatively small change to a general sheet feeding device of the image forming apparatus. Furthermore, a complicated control system is not needed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Embodiments of the present invention will be described with reference to the attached drawings.

Embodiment 1

Figure 1:
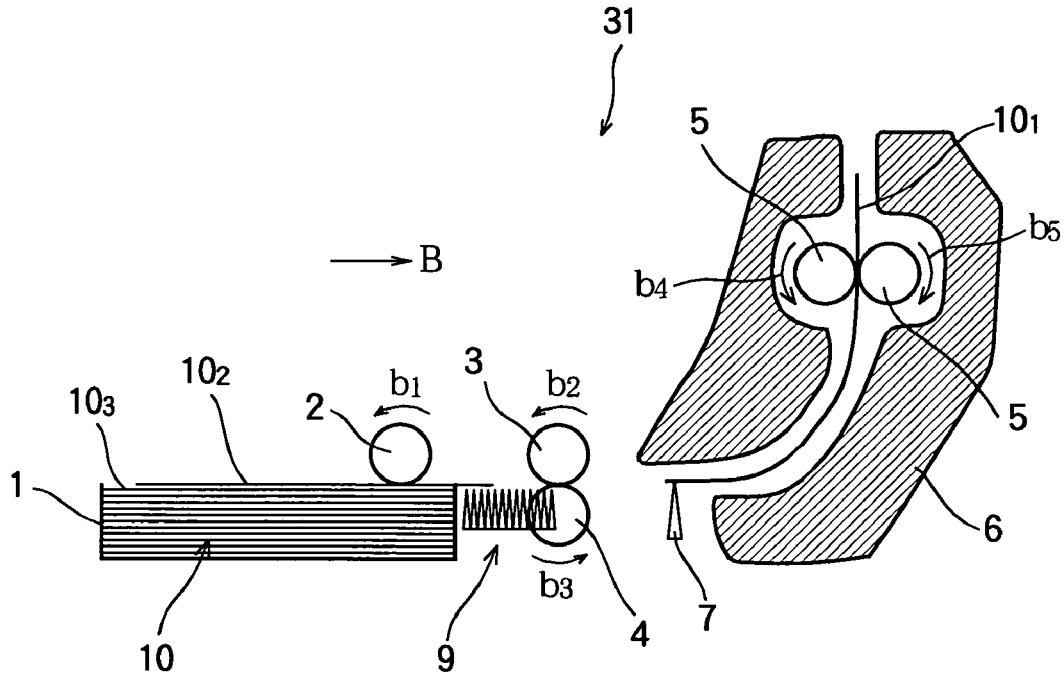
FIG. 1 is a schematic view of the main part of a sheet feeding device of an image forming apparatus according to Embodiment 1 of the present invention.
Figure 2:
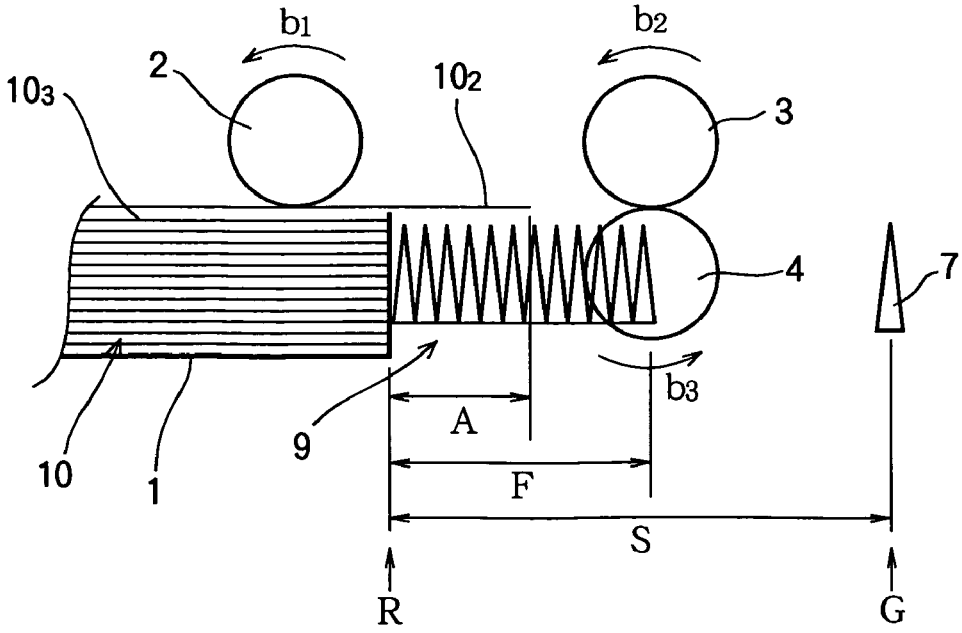
FIG. 2 is an enlarged schematic view of a part including a leading end position sensor and a sheet sensor of the sheet feeding device shown in FIG. 1.

FIG. 1 is a schematic view of the main part of a sheet feeding device (i.e., a medium feeding device) 31 of an image forming apparatus according to Embodiment 1 of the present invention. FIG. 2 is an enlarged schematic view of a part of the sheet feeding device 31. As shown in FIG. 1, the sheet feeding device 31 includes a sheet storing portion (i.e., a storing portion) 1 in which a plurality of printing sheets (i.e., printing media) 10 is stored, and a first feeding roller 2 disposed on the upper side of the storing portion 1. The first feeding roller 2 rotates as shown in an arrow b1 in FIG. 1 in contact with the uppermost printing sheet 10 which is to be fed. The first feeding roller 2 feeds the printing sheet 10 one by one to the outside of the storing portion 1 in the direction indicated by an arrow B. The position of the right end (i.e., the downstream end) of the storing portion 1 is referred to as a sheet reference position R.

Figure 3:
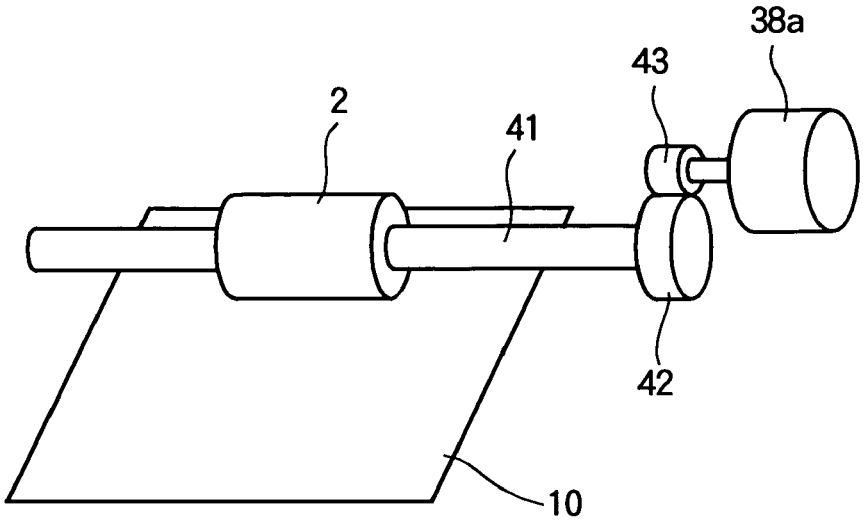
FIG. 3 is a perspective view of the main part of a first feeding roller and a power transmission mechanism thereof.

FIG. 3 is a perspective view of the first feeding roller 2 and a power transmission mechanism for rotating the first feeding roller 2. The first feeding roller 2 is made of rubber, and is supported by a first feeding roller shaft 41. A gear 42 is fixed to an end (i.e., a right end in FIG. 3) of the first feeding roller shaft 41. A first feeding motor 38*a* is provided for rotating the first feeding roller 2. The first feeding motor 38*a* has an output shaft and a gear 43 fixed to an end of the output shaft. The sheet feeding shaft 41 and the first feeding motor 38*a* are so disposed that the gear 42 and the gear 43 engage each other.

As shown in FIGS. 1 and 2, the sheet feeding device 31 includes a second feeding roller 3 and a retard roller 4 provided outside the storing portion 1 and disposed at the downstream side of the first feeding roller 2 in the direction B. The second feeding roller 3 rotates as indicated by an arrow b2 in FIG. 1, and feeds the printing sheet 10 (having been fed by the first feeding roller 2) along a sheet feeding path. A guide 6 is provided for guiding the printing sheet 10 along the sheet feeding path. The retard roller 4 is provided in opposition to the second feeding roller 3. The retard roller 4 rotates in the same direction as the second feeding roller 3 (i.e., in the direction opposite to the feeding direction of the printing sheet 10) as indicated by an arrow b3. When a plurality of printing sheets 10 are fed by the first feeding roller 2 at the same time, the retard roller 4 separates the printing sheets 10 from each other. The sheet feeding device 31 further includes a pair of resist rollers 5 provided in the guide 6 and disposed along the sheet feeding path. The resist rollers 5 respectively rotate as indicated by arrows b4 and b5. The resist rollers 5 correct the skewing of the printing sheet 10 (fed from the second feeding roller 3) and further feed the printing sheet 10 toward an image forming portion 52 (FIG. 7) of the image forming apparatus described later.

The sheet feeding device 31 includes a sheet sensor 7 disposed at the downstream side of the second feeding roller 3 in the direction B, for detecting a leading end or a trailing end of a printing medium 10 fed along the sheet feeding path. The sheet sensor 7 detects the printing sheet 10 passing through a detecting position on which the sheet sensor 7 is disposed, and outputs H-level signal when the sheet sensor 7 detects the printing sheet 10 and L-level signal when the sheet sensor 7 does not detect the printing sheet 10.

The sheet feeding device 31 further includes a leading end position sensor 9. When a preceding printing sheet 10 is fed by the first feeding roller 2 to the second feeding roller 3, a subsequent printing sheet 10 may adhere to the preceding printing sheet 10 and may protrude from the storing portion 1 over the sheet reference position R. The protruding amount of the printing sheet 10 is not constant, and therefore the leading end position sensor 9 is provided for detecting the protruding amount of the subsequent printing sheet 10.

Figure 4:
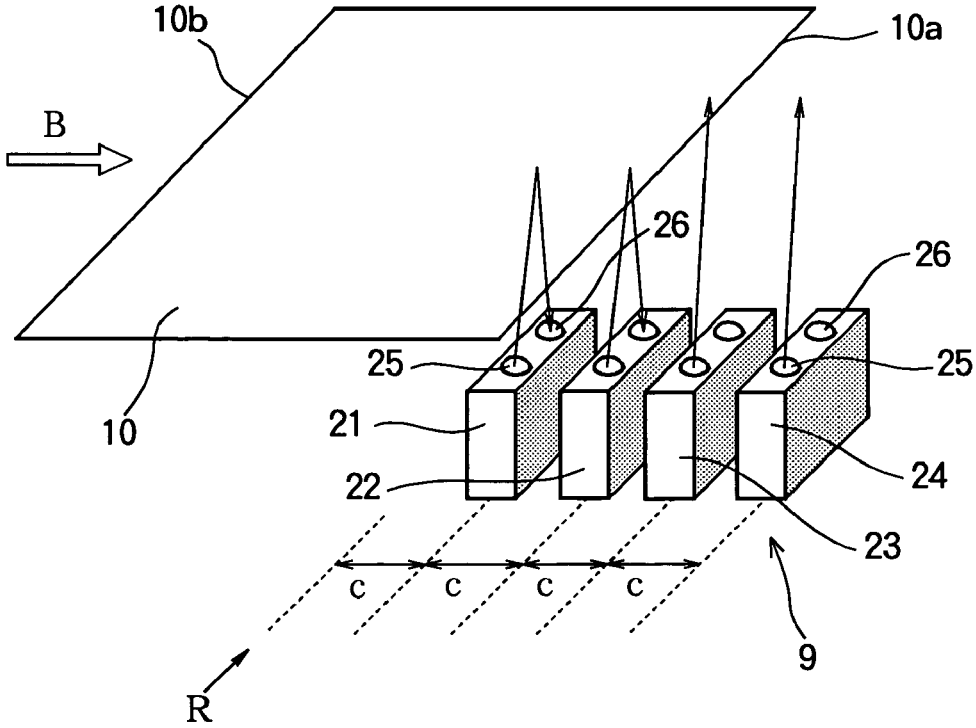
FIG. 4 is a perspective view of an example of the structure of the leading end position sensor shown in FIG. 2.

FIG. 4 is an example of the structure of the leading end position sensor 9. The leading end position sensor 9 includes a plurality of reflective sensors, for example, four reflective sensors 21, 22, 23 and 24 disposed at constant spatial intervals C in the feeding direction B of the printing sheet 10. Each of the reflective sensors 21, 22, 23 and 24 includes a light emitting portion 25 that emits light and a light receiving portion 26 that receives and detects the light. In the example shown in FIG. 4, the printing sheet 10 exists on the reflective sensors 21 and 22. In the reflective sensors 21 and 22 that face the printing sheet 10, the lights emitted by the light emitting portions 25 are reflected by the printing sheet 10 and received by the light receiving portions 26. In the reflective sensors 23 and 24 that do not face the printing sheet 10, the lights emitted by the light emitting portions 25 are not reflected by the printing sheet 10 and therefore not received by the light receiving portions 26.

With such an arrangement, a CPU 34 (FIG. 6) is able to recognize the distance from the sheet reference position R to the leading end 10*a* of the printing sheet 10 (i.e., the protruding amount A) by determining which light receiving portion 26 receives the light. The leading end position sensor 9 constitutes a protruding amount detecting unit for detecting the protruding amount A of the printing sheet 10. The light receiving portions 26 of the reflective sensors 21 through 24 constitute detecting portions that respectively detect the printing sheet 10.

Figure 5B:
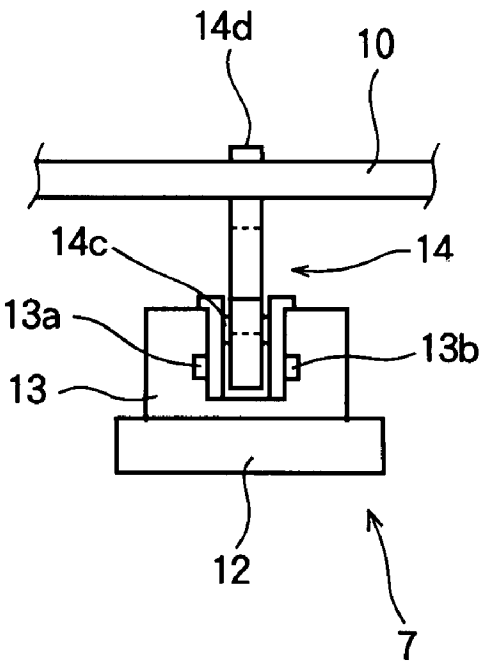
FIGS. 5A and 5B are a side view and a front view of the example of the structure of the sheet sensor shown in FIG. 2.
Figure 5A:
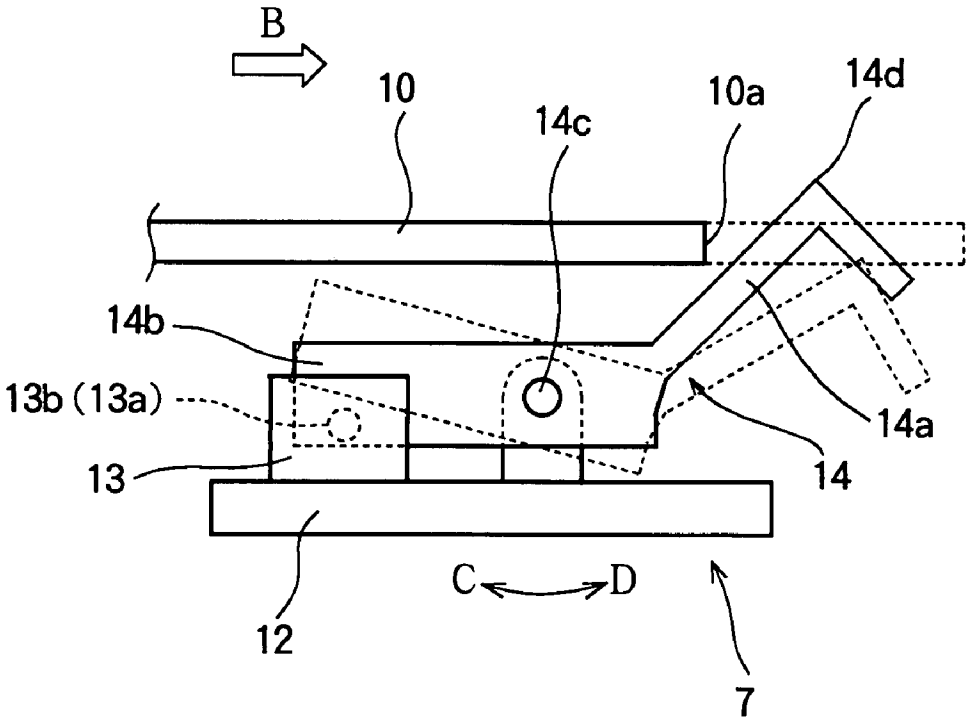

FIGS. 5A and 5B are a side view and a front view showing an example of the structure of the sheet sensor 7 shown in FIG. 2.

As shown in FIGS. 5A and 5B, the sheet sensor 7 includes a base 12, a sensor lever 14 swingably supported by a shaft 14*c* on the base 12, and a transmissive sensor 13 mounted on the base 12. The sensor lever 14 includes an arm portion 14*a* having a bent portion 14*d* pushed by the printing sheet 10 moving along the sheet feeding path, and a shield portion 14*b* that is able to shield the light of the transmissive sensor 13. The sensor lever 14 is urged by a torsion spring (not shown) in a direction indicated by an arrow D to a rotational reference position shown by a solid line in FIG. 5A. The transmissive sensor 13 includes a light emitting portion 13*a* and a light receiving portion 13*b* that face each other as shown in FIG. 5B. When the sensor lever 14 is in the rotational reference position, the shield portion 14*b* of the sensor lever 14 exists between the light emitting portion 13*a* and the light receiving portion 13*b*, with the result that the light receiving portion 13*b* does not receive the light from the light emitting portion 13*a*.

When the printing sheet 14 proceeds in the direction B along the sheet feeding path, the leading end 10*a* of the printing sheet 10 abuts against the arm portion 14*a* of the sensor lever 14, so that the sensor lever 14 rotates as shown by an arrow C to a rotational detecting position shown by a broken line in FIG. 5. The sensor lever 14 stays at this rotational detecting position until the trailing end 10*b* (FIG. 4) of the printing sheet 10 passes through the bent portion 14*d* of the arm portion 14*a*. In this state, the shield portion 14*b* of the sensor lever 14 does not exist between the light emitting portion 13*a* and the light receiving portion 13*b*, with the result that the light receiving portion 13*b* receives the light from the light emitting portion 13*a*.

Accordingly, the CPU 34 (FIG. 6) is able to recognize whether the printing sheet 10 is passing through the sheet sensor 7 or not, according to the state of the transmissive sensor 13, i.e., whether the light receiving portion 13*b* receives the light from the light emitting portion 13*a* or not. Moreover, the CPU 34 is able to detect the timing when the leading end 10*a* or the trailing end 10*b* of the printing sheet 10 passes through the sheet sensor 7, according to the state of the transmissive sensor 13. Since the arm portion 14*a* of the sheet sensor 7 contacts the printing sheet 10 at a position apart from the transmissive sensor 13, it becomes possible to prevent the misdetection caused by sheet dust. The sheet sensor 7 constitutes a timing detection unit that detects the timing when the printing sheet 10 reaches a predetermined position along the sheet feeding path.

Figure 6:
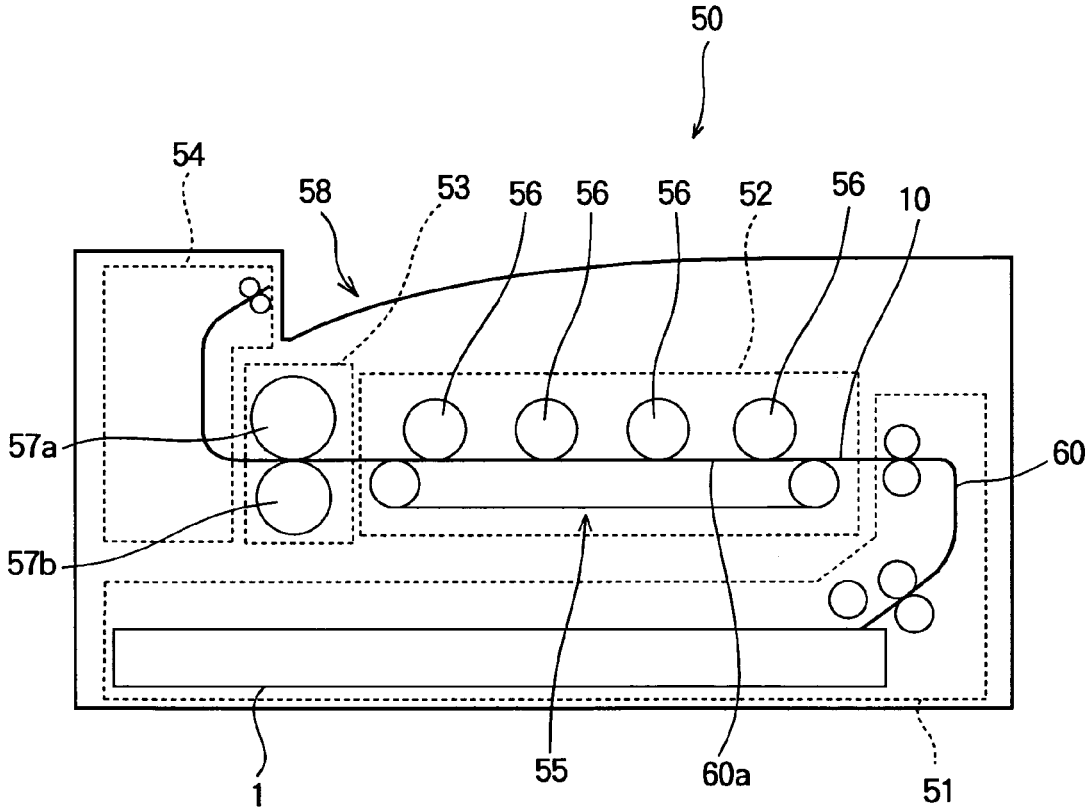
FIG. 6 is a sectional view of a printer having the sheet feeding device according to Embodiment 1 of the present invention.

FIG. 6 is a sectional view illustrating a printer 50 using the above described sheet feeding device 31.

The printer 50 (i.e., an image forming apparatus) includes a sheet feeding portion 51 constructed by the sheet feeding device 31, an image forming portion 52, a fixing portion 53, and a sheet eject portion 54. The image forming portion 52 has a conveyor belt 55 that feeds the printing sheet 10 (having been fed by the sheet feeding portion 51) along a sheet feeding path 60*a* and four toner image forming units 56 of yellow, magenta, cyan and black disposed in this order from the upstream side to the downstream side along the sheet feeding path 60*a*. After the image forming units 56 respectively form images of yellow, magenta, cyan and black on the printing sheet 10, the conveyor belt 55 feeds the printing sheet 10 to the fixing portion 53. The fixing portion 53 fixes the toner image by applying heat and pressure to the printing sheet 10 by means of a fixing roller 57*a* and a pressure roller 57*b*. The sheet ejecting portion 54 ejects the printing sheet 10 (to which the toner image has been fixed) to a stacker 58 formed on the top of the printer 50.

Figure 7:
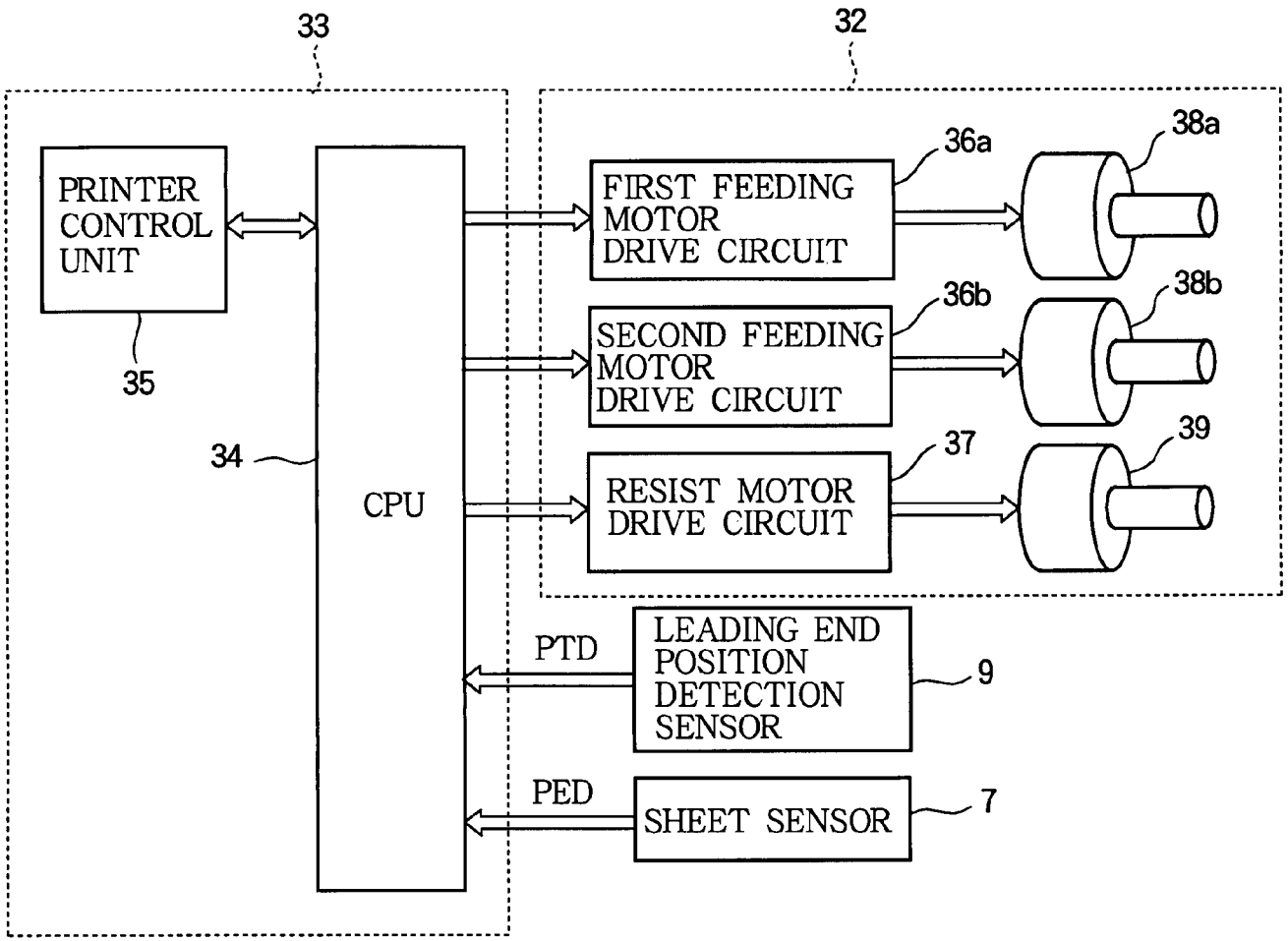
FIG. 7 is a block diagram illustrating a control system of a sheet feeding controller that controls the sheet feeding device according to Embodiment 1.

FIG. 7 is a block diagram illustrating a control system of a sheet feeding controller 33 that controls the operation of the sheet feeding device 31.

As shown in FIG. 7, the sheet feeding controller 33 includes the CPU 34. An input/output portion of the CPU 34 is connected to an input/output portion of a printer control unit 35 that controls the whole operation of the printer 50. Output portions of the CPU 34 are connected to a first feeding motor drive circuit 36*a*, a second feeding motor drive circuit 36*b*, and a resist motor drive circuit 37. Input portions of the CPU 34 are connected to the leading end position sensor 9 and the sheet sensor 7.

The first feeding motor drive circuit 36*a* applies current to the first feeding motor 38*a* for rotating the first feeding roller 2 in response to the instruction from the CPU 34. The first feeding motor drive circuit 36*a* drives the first feeding motor 38*a* so that the first feeding roller 2 rotates by an amount sufficient to feed one printing sheet 10 to the second feeding roller 3. The first feeding roller 2, components for driving the first feeding roller 2 (i.e., the CPU 34, the first feeding motor drive circuit 36*a*, and the first feeding motor 38*a* or the like) constitute a first feeding unit.

The second feeding motor drive circuit 36*b* applies current to a second feeding motor 38*b* for rotating the second feeding roller 3 in response to the instruction from the CPU 34. The second feeding motor drive circuit 36*b* is able to drive the second feeding motor 38*b* so that the second feeding roller 3 continuously rotates during the continuous printing operation. Alternatively, the second feeding motor drive circuit 36*b* is able to drive the second feeding motor 38*b* so that the second feeding roller 3 starts rotating at a timing (or, prior to a timing) when the first feeding roller 2 starts rotating. The second feeding roller 3, components for driving the second feeding roller 3 (i.e., the CPU 34, the second feeding motor drive circuit 36*b*, and the second feeding motor 38*b* or the like) and the guide 6 constitute a second feeding unit.

The resist motor drive circuit 37 is connected to a resist motor 39 for rotating the resist rollers 5 via a not-shown transmission, and applies current to the resist motor 39 for rotating the resist rollers 5 in response to the instruction from the CPU 34. The resist motor drive circuit 37 drives the resist motor 39 so that the resist rollers 5 rotate by an amount sufficient to feed one printing sheet 10.

The operation of the sheet feeding device 31 will be described. Hereinafter, a preceding printing sheet is denoted by a numeral $\mathbf{10}_1$, and the subsequent printing sheet (fed next to the preceding printing sheet $\mathbf{10}_1$) is denoted by a numeral $\mathbf{10}_2$. An arbitrary printing sheet is denoted by a numeral 10 with no numerical subscript.

In FIG. 1, as the first feeding roller 2 rotates, the uppermost (i.e., preceding) printing sheet $\mathbf{10}_1$ in the storing portion 1 is fed in the direction B and reaches the second feeding roller 3. In this state, there is a possibility that the subsequent printing sheet $\mathbf{10}_2$ may move together with the printing sheet $\mathbf{10}_1$ because of the static electricity. However, the subsequent printing sheet $\mathbf{10}_2$ is separated from the preceding printing sheet $\mathbf{10}_1$ by the retard roller 4 rotating in the direction opposite to the feeding direction B.

The printing sheet $\mathbf{10}_1$ having reached the second feeding roller 3 is further fed by the second feeding roller 3, and reaches the resist rollers 5. The resist rollers 5 do not start rotating for a predetermined period after the leading end (or the trailing end) of the printing sheet $\mathbf{10}_1$ abuts against the resist rollers 5. In this period, the printing sheet $\mathbf{10}_1$ warps by a predetermined amount, so that the skewing of the printing sheet $\mathbf{10}_1$ is corrected. When the predetermined time has elapsed after the leading end (or the trailing end) of the printing sheet $\mathbf{10}_1$ is detected by the sheet sensor 7, the resist roller 5 starts rotating. In the state shown in FIG. 1, the printing sheet $\mathbf{10}_1$ is further fed to a position where the trailing end of the printing sheet $\mathbf{10}_1$ reaches the sheet sensor 7.

Next, the detection of the position of the leading end of the subsequent printing sheet $\mathbf{10}_2$ will be described in detail with reference to FIG. 2. When the preceding printing sheet $\mathbf{10}_1$ is fed by the first feeding roller 2, there is a possibility that the subsequent printing sheet $\mathbf{10}_2$ may adhere to the preceding printing sheet $\mathbf{10}_1$ and may protrude over the sheet reference position R. Further, there is another possibility that the subsequent printing sheet $\mathbf{10}_2$ may not protrude over the sheet reference position R and may remain in the storing portion 1. Thus, when the feeding of the subsequent printing sheet $\mathbf{10}_2$ is to be started, the position of the leading end of the subsequent printing sheet $\mathbf{10}_2$ may deviate.

The distance from the sheet reference position R to the leading end of the printing sheet $\mathbf{10}_2$ is defined as the protruding amount A as was described above. The leading end position sensor 9 detects the protruding amount A and outputs a sheet position detection signal PTD including the information of the protruding amount A. For example, the leading end position sensor 9 (having the structure of FIG. 4) outputs the sheet position detection signal PTD including the detection signals from the reflective sensor 21, 22, 23 and 24. The sheet position detection signal PTD is inputted into the CPU 34 (FIG. 6). The detection signal is at H-level when the light receiving portion 26 receives the light, and at L-level when the light receiving portion 26 does not receive the light. In the example shown in FIG. 4, reflective sensors 21 and 22 output detection signals at H-level and the reflective sensors 23 and 24 output detection signals at L-level. Therefore, the CPU 34 recognizes that the protruding amount A is within the following range:

$$C\times 2<A<C\times 3$$

where C is the above described spatial interval between the adjacent reflective sensors 21, 22, 23 and 24.

The accuracy in detecting the protruding amount A can be enhanced by increasing the number of the reflective sensors, i.e., by reducing the spatial interval C.

Next, the detection of the leading end or the trailing end of the printing sheet 10 (having passed through the sheet sensor 7) will be described. The sheet sensor 7 is disposed at a predetermined position G as shown in FIG. 1. The example of the structure of the sheet sensor 7 has been described with reference to FIG. 5A.

As shown in FIG. 5A, when the printing sheet 10 is passing through the sheet sensor 7, the photosensitive sensor 13 of the sheet sensor 7 is in a light receiving state in which the light receiving portion 13*b* receives the light from the light emitting portion 13*a*. When the printing sheet 10 is not passing through the sheet sensor 7, the photosensitive sensor 13 of the sheet sensor 7 is in a light shielding state in which the light receiving portion 13*b* does not receive the light from the light emitting portion 13*a*. The sheet sensor 7 outputs a sheet end detection signal PED which is at H-level in the light receiving state and at L-level in the light shielding state. The sheet end detection signal PED is inputted into the CPU 34. The CPU 34 recognizes the timing when the leading end 10*a* of the printing sheet 10 passes through the sheet sensor 7 based on the sheet end detection signal PED changing from L-level to H-level. Further, the CPU 34 is able to recognize the timing when the trailing end 10*b* of the printing sheet 10 passes through the sheet sensor 7 based on the sheet end detection signal PED changing from H-level to L-level.

Next, the controlling method for keeping the constant spatial interval between the printing sheets 10 will be described with reference to FIGS. 1 and 2 showing the feeding of the preceding printing sheets $\mathbf{10}_1$ and the subsequent printing sheet $\mathbf{10}_2$.

When the CPU 34 (FIG. 6) receives an instruction to start the continuous printing operation from the printer control unit 35, the CPU 34 calculates the protruding amount of the subsequent printing sheet $\mathbf{10}_2$ based on the sheet position detection signal PTD from the leading end position sensor 9. Further, the CPU 34 recognizes the timing when the trailing end of the preceding printing sheet $\mathbf{10}_1$ passes through the sheet sensor 7, based on the sheet end detection signal PED from the sheet sensor 7. Then, the CPU 34 determines the timing when the feeding of the subsequent printing sheet $\mathbf{10}_2$ is to be started. In particular, the CPU 34 starts feeding the subsequent printing sheet $\mathbf{10}_2$ when an adjusting time has elapsed after the trailing end of the printing sheet 10 is detected by the sheet sensor 7. The adjusting time t (s) can be determined according to the following equation (1):

$$t=\{W-(S-A)\}/V \tag{1}$$

In the equation (1), W indicates a target spatial interval (mm) between the trailing end of the preceding printing sheet $\mathbf{10}_1$ and the leading end of the subsequent printing sheet $\mathbf{10}_2$. V indicates a feeding speed (mm/s) of the printing sheet 10 fed by the first feeding roller 2. A indicates the protruding amount, i.e., the distance (mm) from the sheet reference position R to the leading end of the subsequent printing sheet $\mathbf{10}_2$. S indicates the distance (mm) from the sheet reference position R to the detecting position of the sheet sensor 7.

By starting the feeding of the subsequent printing sheet $\mathbf{10}_2$ when the adjusting time t has elapsed after the sheet sensor 7 detects the trailing end of the preceding printing sheet $\mathbf{10}_1$, it becomes possible to obtain the target spatial interval W between the preceding printing sheet $\mathbf{10}_1$ and the subsequent printing sheet $\mathbf{10}_2$. The CPU 34 instructs the first feeding motor drive circuit 36*a* to start rotating when the adjusting time t has elapsed. The CPU 34 constitutes a feeding control unit that determines the timing when the feeding of the subsequent printing sheet $\mathbf{10}_2$ is to be started.

The feeding speed of the first feeding roller 2 is the same as the feeding speed of the second feeding roller 3. In particular, a one-way clutch (not shown) is provided between the first feeding roller 2 and the first feeding roller shaft 41 (FIG. 3). The one-way clutch allows the first feeding roller shaft 41 to freewheel after the leading end of the printing sheet 10 reaches the second feeding roller 3, i.e., after the printing sheet 10 starts to be fed by the second feeding roller 3.

Figure 8:
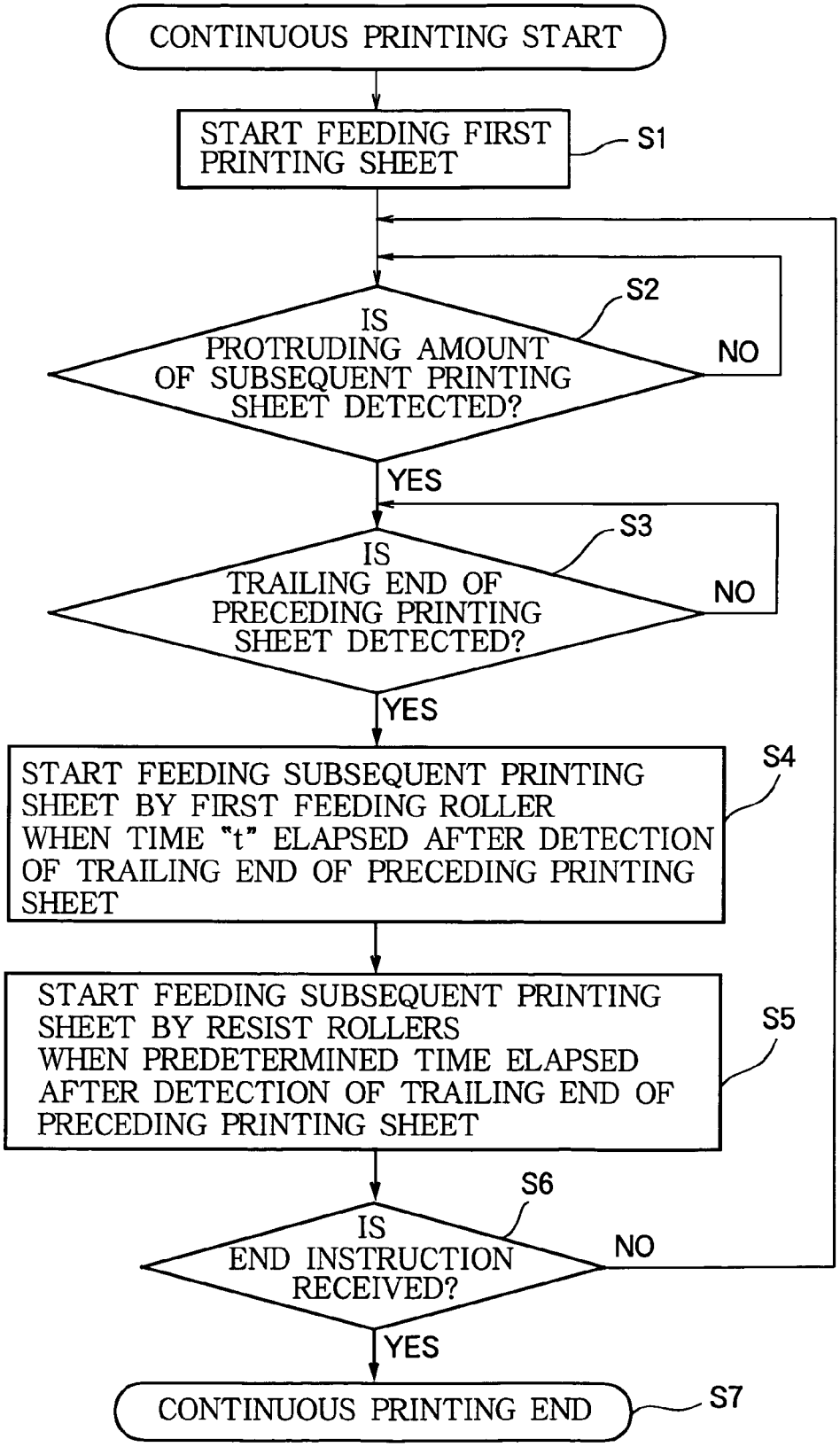
FIG. 8 is a flow chart illustrating an operation performed by CPU of the sheet feeding controller.

FIG. 8 is a flow chart illustrating the operation performed by the CPU 34 (FIG. 6) of the sheet feeding controller 33 that controls the operation of the sheet feeding device 31 (FIG. 1). With reference to FIG. 8, the operation of the sheet feeding device 31 will be described.

When the continuous printing operation is started in response to the instruction from the printer control unit 35, the CPU 34 drives the first feeding motor 38*a* to rotate the first feeding roller 2, i.e., to start feeding the first (preceding) printing sheet $\mathbf{10}_1$ (step S1). The amount of the rotation of the first feeding roller 2 is set to an amount by which the first feeding roller 2 feeds one printing sheet $\mathbf{10}_1$ to the second feeding roller 3. In this state, the protruding amount A of the second (subsequent) printing sheet $\mathbf{10}_2$ may deviates in the following range:

$$0\ (\text{mm}) \leqq A\ (\text{mm}) \leqq F\ (\text{mm})$$

At a stage when the trailing end of the preceding printing sheet $\mathbf{10}_1$ passes through the second feeding roller 3, the CPU 34 calculates the protruding amount A of the second (subsequent) printing sheet $\mathbf{10}_2$ based on the sheet position detection signal PTD sent by the leading end detection signal 9, and calculates the adjusting time t according to the equation (1) (step S2).

The CPU 34 checks the sheet end detection signal PED sent by the sheet sensor 7 so as to recognize the timing when the trailing end of the preceding printing sheet $\mathbf{10}_1$ passes through the sheet sensor 7 at the position G distanced from the sheet reference position R by the distance S (step S3). If the passage of the trailing end of the preceding printing sheet $\mathbf{10}_1$ is detected by the sheet sensor 7, the CPU 34 drives the first feeding motor 38*a* to start rotating the first feeding roller 2 when the adjusting time t has elapsed after the trailing end of the preceding printing sheet $\mathbf{10}_1$ is detected, so that the feeding of the second (subsequent) printing sheet $\mathbf{10}_1$ is started (step S4). The first printing sheet $\mathbf{10}_1$ and the second printing sheet $\mathbf{10}_2$ are fed in such a manner that the target spatial interval W is formed between the first printing sheet $\mathbf{10}_1$ and the second printing sheet $\mathbf{10}_2$.

The CPU 34 measures an elapsed time after the trailing end 10*b* of the first (preceding) printing sheet $\mathbf{10}_1$ passed through the sheet detecting position of the sheet sensor 7 (i.e., the position G). When the elapsed time reaches a predetermined time sufficient for the printing sheet $\mathbf{10}_1$ to abut against the resist rollers 5 and warps by the predetermined amount, the CPU 34 starts rotating the resist rollers 5 to feed the printing sheet $\mathbf{10}_1$ to the image forming portion 52 shown in FIG. 6 (step S5).

Then, the CPU 34 checks if the CPU 34 receives the instruction to end the continuous printing operation from the printer control unit 35 (step S6). If the CPU 34 receives the instruction to end the continuous printing operation from the printer control unit 35, the CPU 34 ends the continuous printing operation (step S7). If the CPU 34 does not receive the instruction to end the continuous printing operation, the CPU 34 proceeds to the step S2 and calculates the protruding amount A of the third printing sheet $10_3$ when the trailing end of the second printing sheet $10_2$ reaches the second feeding roller 3. Further, the processes from the step S2 to the step S7 are repeated.

In the processes shown in FIG. 8, it is possible to continuously rotate the second feeding roller 3 during the continuous printing operation, or to start rotating the second feeding roller 3 at a timing (or, prior to a timing) when the first feeding roller 2 starts rotating.

In the above described embodiment, the leading end position sensor 9 is constructed as shown in FIG. 4. However, the leading end position sensor 9 can be replaced by, for example, a leading end position sensor 16 shown in FIG. 9.

Figure 9:
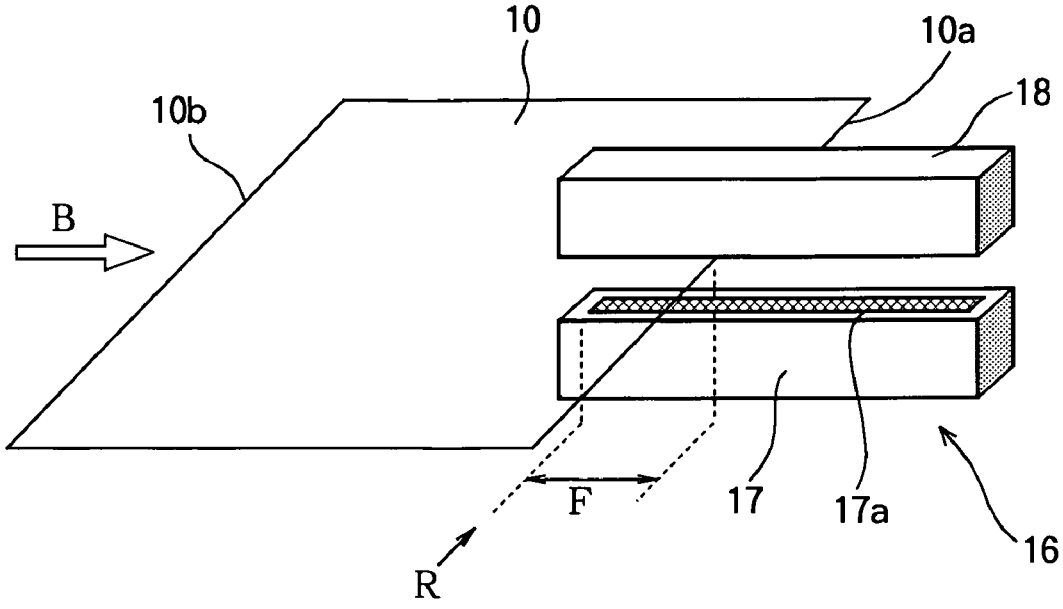
FIG. 9 is a perspective view of another example of the structure of the sheet sensor using a line sensor.

As shown in FIG. 9, the leading end position sensor 16 includes a line sensor 17 extending in the direction B and a light source 18 provided in opposition to the line sensor 17. The line sensor 17 has an image sensor 17*a* that receives the light from the light source 18. The image sensor 17*a* outputs, for example, an electric signal whose level changes according to the amount of the incident light. The line sensor 17 and the light source 18 are so disposed that the printing sheet 10 passes through the gap between the light source 18 and the line sensor 17. The amount of the light incident on the line sensor 17 changes according to the protruding amount A of the printing sheet 10 from the sheet reference position R. The electric signal is inputted into the CPU 34 as the sheet position detection signal PTD. The CPU 34 has a comparison table stored in a memory, in which the level of the inputted electric signal (i.e., the sheet position detection signal PTD) and the protruding amount A of the printing sheet $10_2$ are associated with each other. According to the comparison table, the CPU 34 recognizes the protruding amount A of the subsequent printing sheet $10_2$. With such an arrangement, it is possible to use the leading end position sensor 16 shown in FIG. 9 instead of the leading end position sensor 9 shown in FIG. 4.

In the above description, the CPU 34 calculates the protruding amount A of the subsequent printing sheet $10_2$ based on the sheet position detection signal PTD, and the CPU 34 determines the timing of starting the feeding of the subsequent printing sheet $10_2$ based on the protruding amount A. However, it is also possible to previously determine the relationship between the detected position of the leading end of the protruding printing sheet $10_2$ and the timing of starting the feeding of the subsequent printing sheet $10_2$. The CPU 34 determines the timing of starting the feeding of the subsequent printing sheet $10_2$ directly based on the sheet position detection signal PTD. In this case, the leading end position sensor 9 constitutes a position detection unit that outputs a positional information (i.e., the sheet position detection signal PTD) of the leading end of the subsequent printing sheet $10_2$.

Moreover, in the above description, the timing of starting the feeding of the subsequent printing sheet $10_2$ is determined based on the timing when the trailing of the preceding printing sheet $10_1$ is detected by the sheet sensor 7. However, it is possible to determine the timing of starting the feeding of the subsequent printing sheet $10_2$ based on the timing when the leading end of the preceding printing sheet $10_1$ is detected by the sheet sensor 7 and the length of the printing sheet 10.

As described above, according to the sheet feeding device 31 of Embodiment 1, the timing of starting the feeding of the subsequent printing sheet $10_2$ is determined based on the protruding amount A of the subsequent printing sheet $10_2$ from the sheet reference position R, and therefore it becomes possible to maintain the constant spatial interval between the preceding printing sheet $10_1$ and the subsequent printing sheet $10_2$ with high accuracy. Thus, it becomes possible to accomplish the image forming apparatus capable of feeding printing sheets 10 at constant spatial intervals, without making a significant change to the structure of a general image forming apparatus and without requiring a complicated control system.

Moreover, since the spatial intervals between the printing sheets 10 can be kept constant with high accuracy, it becomes possible to set the spatial intervals between the printing sheets 10 as short as possible, and therefore it becomes possible to increase the printing speed.

Embodiment 2

Figure 10:
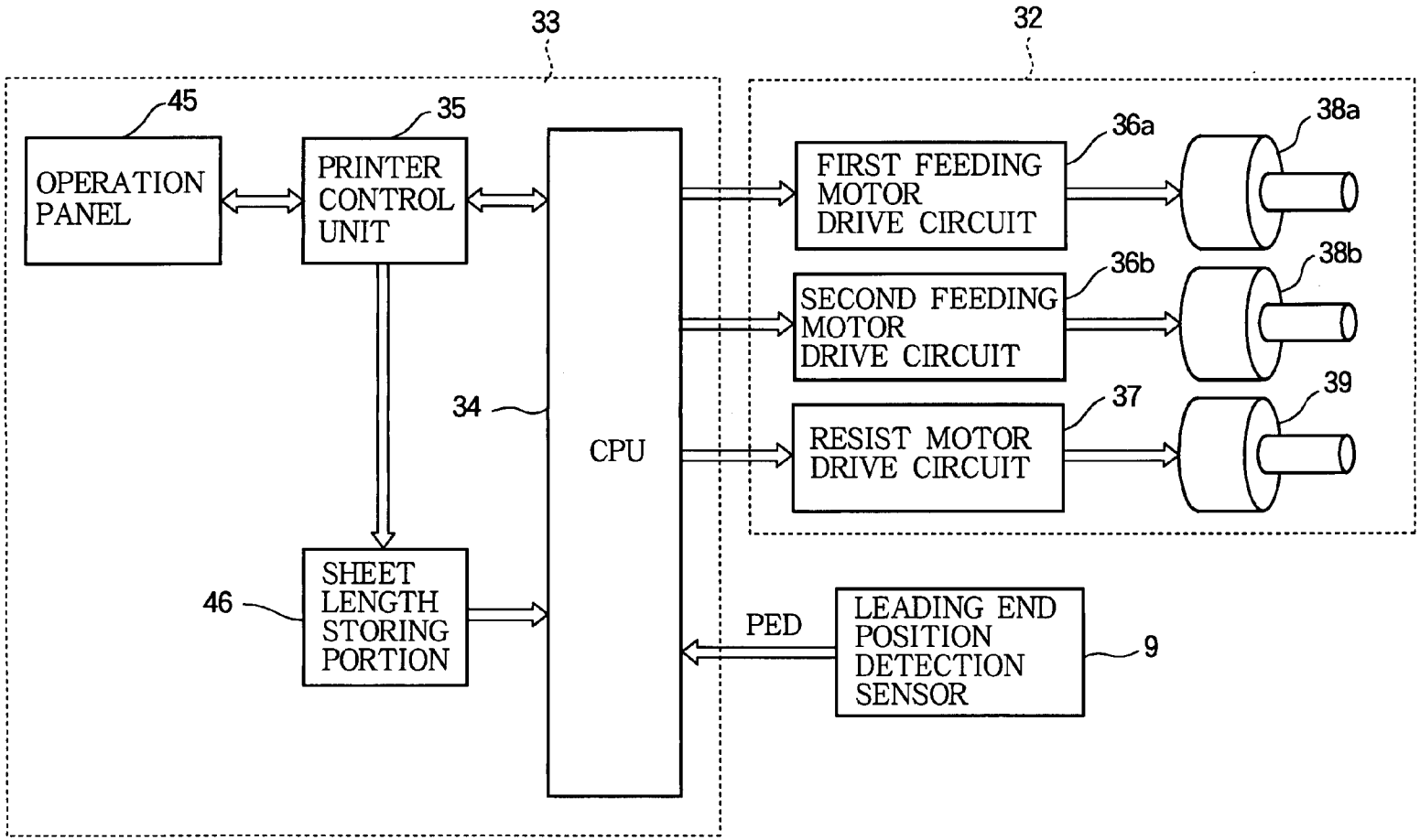
FIG. 10 is a block diagram illustrating a control system of a sheet feeding device according to Embodiment 2 of the present invention.

FIG. 10 is a block diagram illustrating a control system of a sheet feeding device used in an image forming apparatus according to Embodiment 2 of the present invention.

Different from the sheet feeding device 31 of Embodiment 1 (FIG. 6), the sheet feeding device of Embodiment 2 has no sheet sensor 7. In the sheet feeding device of Embodiment 2, the sheet feeding controller 33 includes an operation panel 45 for inputting the length of the printing sheet 10 in the feeding direction (hereinafter, referred to as a sheet length D). The sheet feeding controller 33 further includes a sheet length storing portion 46 for storing the inputted sheet length D. The CPU 34 of the sheet feeding controller 33 controls the feeding of the printing sheet 10 without using the sheet sensor 7 (FIG. 7). Other components of the sheet feeding device of Embodiment 2 are the same as the components of the sheet feeding device 31 of Embodiment 1.

In FIG. 10, when the sheet length D of the printing sheet 10 is inputted by means of the operation panel 45, the printer control unit 35 stores the sheet length D in the sheet length storing portion 46. Based on the sheet length D stored in the sheet length storing portion 46, the CPU 34 determines the timing when the trailing end of the printing sheet 10 passes through the position G distanced from the sheet reference position R by the distance S as shown in FIG. 2 (corresponding to the detecting position of the sheet sensor 7 in Embodiment 1).

The CPU 34 determines an elapsed time ta before the trailing end of the printing sheet 10 (whose leading end is distanced from the sheet reference position R by the distance A) passes through the position G according to the following equation (2).

$$ta=\{(S-A)+D\}/V \tag{2}$$

In the equation (2), S indicates the distance (mm) from the sheet reference position R to the predetermined position G. A indicates the distance (mm) from the sheet reference position R to the leading end of the printing sheet 10 (i.e., the protruding amount). D indicates the above described sheet length (mm). V indicates the feeding speed (mm/s) of the printing sheet 10 fed by the first feeding roller 2.

Figure 11A:
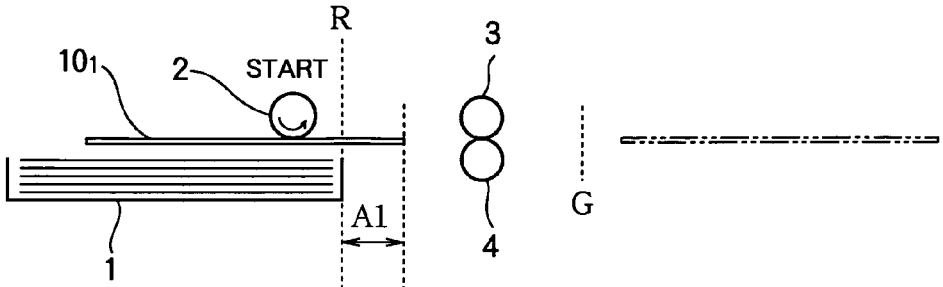
FIGS. 11A, 11B and 11C are schematic views illustrating the feeding of the printing sheets by the sheet feeding device according to Embodiment 2 of the present invention.
Figure 11B:
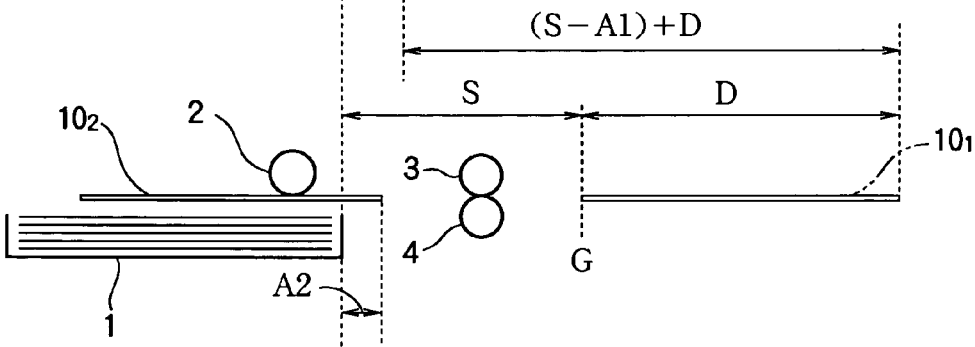
Figure 11C:
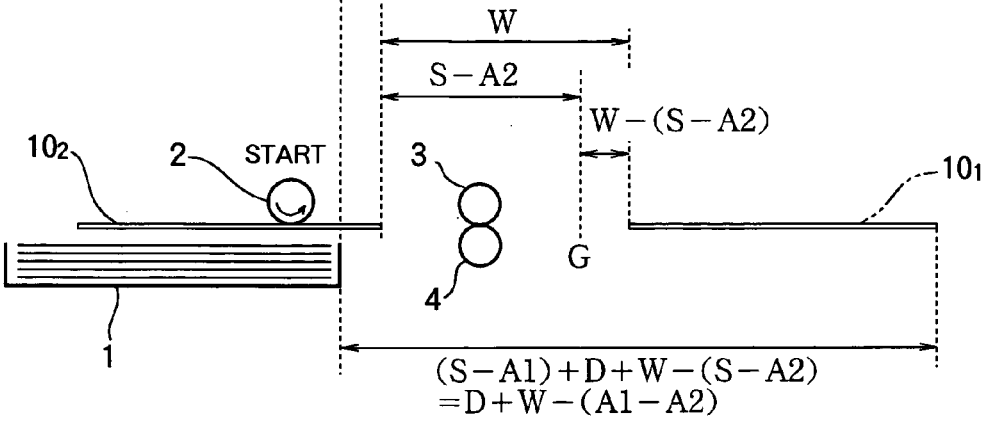

FIG. 11A through 11C illustrate the feeding of the preceding printing sheet $10_1$ and the subsequent printing sheet $10_2$. In FIGS. 11A through 11C, the protruding amount of the preceding printing sheet $10_1$ is expressed as A1, and the protruding amount of the subsequent printing sheet $10_2$ is expressed as A2. The target spatial interval between the printing sheets is expressed as W.

As shown in FIGS. 11A and 11B, the above described elapsed time ta for the preceding printing sheet $10_1$ is expressed as {(S−A1)+D}/V according to the equation (2).

As shown in FIGS. 11A through 1C, the time interval T after the starting of the feeding of the preceding printing sheet $\mathbf{10}_1$ (FIG. 11A) and before the starting of the feeding of the subsequent printing sheet $\mathbf{10}_2$ (FIG. 1C) is obtained by adding the elapsed time ta for the preceding printing sheet $\mathbf{10}_1$(equation (2)) and the adjusting time t for the subsequent printing sheet $\mathbf{10}_2$ (equation (1)) described in Embodiment 1.

Thus, the time interval T is expressed as follows:

$$T = \{(S - A1) + D\}/V + \{W - (S - A2)\}/V \quad (3)$$
$$= \{(D + W) - (A1 - A2)\}/V$$

Accordingly, the CPU 34 controls the protruding amounts A1 and A2 of the preceding and subsequent printing sheets $\mathbf{10}_1$ and $\mathbf{10}_2$ based on the sheet position detection signal PTD sent by the leading end position sensor 9. Further, the CPU 34 determines the time interval T according to the above described equation (3), and instructs the first feeding motor drive circuit 36*a* to start feeding the subsequent printing sheet $\mathbf{10}_2$. Accordingly, the printing sheets 10 can be fed at constant spatial intervals (W).

In the above description of Embodiment 2, the sheet length D is directly inputted by means of the operation panel 45. However, it is possible to employ various alternative arrangements. For example, it is possible that the CPU 34 sets the sheet length D according to the selection of the size of the printing sheet 10 (for example, A4 or B5). Alternatively, it is possible that the CPU 34 automatically detects the sheet length D.

As described above, according to the sheet feeding device of Embodiment 2, it becomes possible to eliminate the sheet sensor 7 (FIG. 1) for detecting the leading end or the trailing end of the printing sheet 10. Therefore, in addition to the advantages of Embodiment 1, it becomes possible to simplify the structure of the image forming apparatus and to reduce the cost of the image forming apparatus.

COMPARATIVE EXAMPLE

Figure 12:
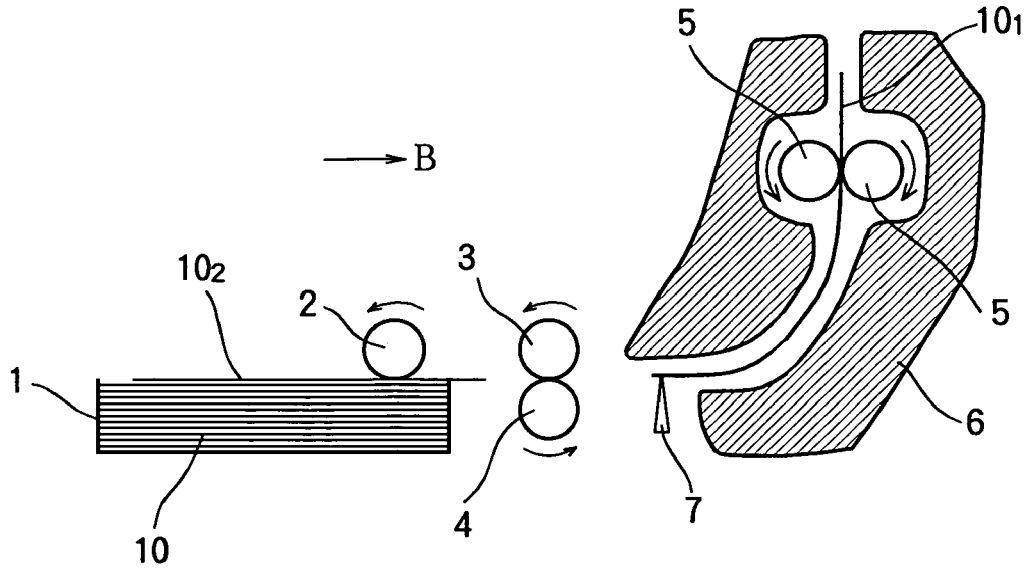
FIG. 12 is a schematic view illustrating the main part of a sheet feeding device according to a comparative example.

A comparative example with respect to Embodiments of the present invention will be described. FIG. 12 is a schematic view of the main part of a sheet feeding device according to the comparative example. In the comparative example, the sheet feeding mechanism has no leading end position sensor 9 for detecting the protruding amount of the subsequent printing sheet $\mathbf{10}_2$. The first feeding roller 2 starts feeding the subsequent printing sheet $\mathbf{10}_2$ when the passage of the trailing end of the preceding printing sheet $\mathbf{10}_1$ is detected by the sheet sensor 7.

Figure 13:
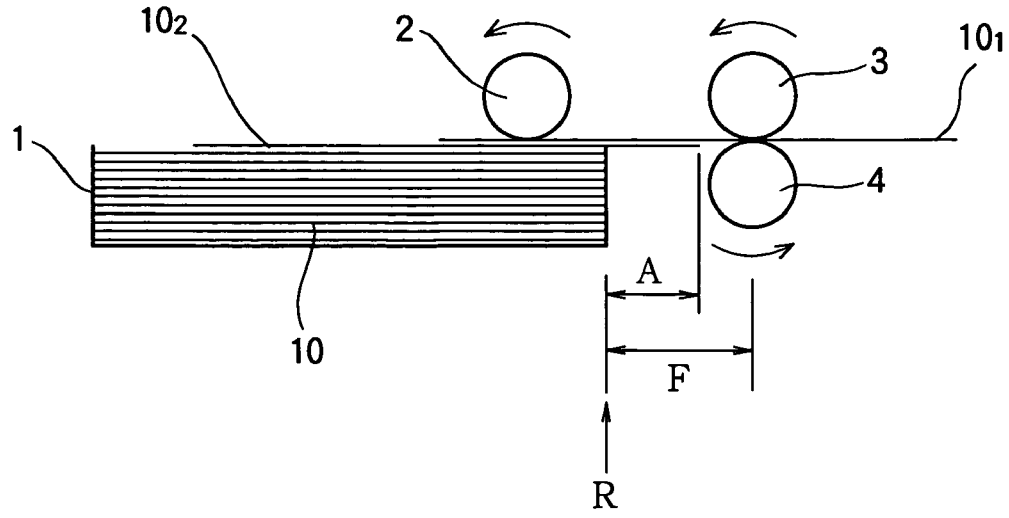
FIG. 13 is a schematic view illustrating the double feeding of two printing sheets by the first feeding roller in the sheet feeding device shown in FIG. 12.

FIG. 13 illustrates a condition in which two printing sheets $\mathbf{10}_1$ and $\mathbf{10}_2$ are simultaneously fed to the second feeding roller 3 because of the static electricity or the like.

As shown in FIG. 13, when the preceding printing sheet $\mathbf{10}_1$ is fed by the first feeding roller 2 in the direction B to the outside of the storing portion 1, the subsequent printing sheet $\mathbf{10}_2$(adhering to the preceding printing sheet $\mathbf{10}_1$ because of the static electricity) may also be fed to the outside of the storing portion 1. The preceding printing sheet $\mathbf{10}_1$ is fed in the direction B by the second feeding roller 3 along the sheet feeding path defined by the guide 6. The subsequent printing sheet $\mathbf{10}_2$ is stopped and separated from the preceding printing sheet $\mathbf{10}_1$ by the retard roller 4 that rotates in the direction opposite to the feeding direction B of the printing sheet 10.

However, the protruding amount A of the subsequent printing sheet $\mathbf{10}_2$ is not constant, and therefore the position of the leading end of the subsequent printing sheet $\mathbf{10}_2$ may deviate in a space between the sheet reference position R and the retard roller 4 as shown in FIG. 13. When the distance from the reference position R to the retard roller 4 is expressed as F, the protruding amount A of the leading end of the subsequent printing sheet $\mathbf{10}_2$ is expressed as follows:

$$0\ (\text{mm}) \leqq A\ (\text{mm}) \leqq F\ (\text{mm})$$

Therefore, if the first feeding roller 2 starts feeding the subsequent printing sheet $\mathbf{10}_2$ when the sheet sensor 7 detects the passage of the trailing end of the preceding printing sheet $\mathbf{10}_1$, the spatial interval between the preceding printing sheet $\mathbf{10}_1$ and the subsequent printing sheet $\mathbf{10}_2$ (shorter than the distance F by the amount A) is not constant. Thus, there is a possibility that the preceding printing sheet $\mathbf{10}_1$ and the subsequent printing sheet $\mathbf{10}_2$ may partially overlap with each other on the feeding path, and therefore problems such as a double feeding or a jam of the printing sheets 10 may occur. In order to prevent the printing sheets 10 from overlapping with each other, it is necessary to increase the spatial interval between the printing sheets 10, and therefore it is difficult to increase the printing speed.

In contrast, according to the above described Embodiments 1 and 2 of the present invention, the CPU 34 determines the timing of starting the feeding of the subsequent printing sheet $\mathbf{10}_2$ according to the protruding amount of the preceding printing sheet $\mathbf{10}_1$, and therefore the spatial interval between the printing sheets 10 can be kept constant with high accuracy. Therefore, it becomes possible to accomplish the image forming apparatus capable of feeding printing sheets 10 at constant spatial intervals, without making a significant change to the structure of the general image forming apparatus. Moreover, since the spatial intervals between the printing sheets 10 can be kept constant with high accuracy, it becomes possible to set the spatial intervals between the printing sheets 10 as short as possible, and therefore it becomes possible to increase the printing speed.

While the preferred embodiments of the present invention have been illustrated in detail, it should be apparent that modifications and improvements may be made to the invention without departing from spirit and scope of the invention as described in the following claims.

What is claimed is:

1. An image forming apparatus comprising:

a storing portion in which a plurality of sheet-shaped printing media are stored;

a first feeding unit capable of feeding one printing medium after another from said printing media stored in said storing portion to the outside of said storing portion;

a second feeding unit that further feeds said printing, medium, having been fed by said first feeding unit, along a predetermined feeding path;

a timing detection unit that detects a timing when said printing medium reaches a predetermined position along said feeding path;

a protruding amount detection unit that detects a protruding amount of a subsequent printing medium protruding from said storing portion in accordance with said second unit feeding a preceding printing medium prior to said subsequent printing medium; and a feeding control unit that determines a timing of starting the feeding of said subsequent printing medium according to said timing of said preceding printing medium reaching said predetermined position detected by said timing detection unit and said protruding amount of said subsequent printing medium detected by said protruding amount detection unit.

2. The image forming apparatus according to claim 1, wherein said timing detection unit detects a timing when a trailing end of said printing medium reaches said predetermined position.

3. The image forming apparatus according to claim 2, wherein said timing detection unit comprises a lever that contacts said printing medium and moves in response to a movement of said printing medium and a sensor that detects a movement of said lever.

4. The image forming apparatus according to claim 1, wherein said protruding amount detected by said protruding amount detection unit corresponds to a distance from a reference position of said storing portion to a leading end of said printing medium protruding from said storing portion.

5. The image forming apparatus according to claim 4, wherein said feeding control unit determines an adjusting time t after said timing detected by said timing detection unit and before said first feeding unit starts feeding said subsequent printing medium according to the following equation:

$$t=\{W-(S-A)\}/V$$

where W indicates a target spatial interval between a trailing end of said preceding printing medium and a leading end of said subsequent printing medium successively fed along said feeding path, V indicates a feeding speed of said first feeding unit, A indicates said protruding amount of said subsequent printing medium, and S indicates a distance from said reference position to said predetermined position.

6. The image forming apparatus according to claim 1, wherein said protruding amount detection unit comprises a plurality of detecting portions for respectively detecting said printing medium, and said detecting portions are arranged along a feeding direction of said printing medium.

7. The image forming apparatus according to claim 1, wherein said protruding amount detection unit comprises a line sensor extending in a feeding direction of said printing medium, and a light emitting portion provided in opposition to said line sensor via said feeding path.

8. An image forming apparatus comprising:

a storing portion in which a plurality of sheet-shaped printing media are stored;

a first feeding unit capable of feeding one printing medium after another from said printing media stored in said storing portion to the outside of said storing portion;

a second feeding unit that further feeds said printing medium, having been fed by said first feeding unit, along a predetermined feeding path;

a timing detection unit that detects a timing when said printing medium reaches a predetermined position along said feeding path;

a position detection unit that detects a positional information of a leading end of a subsequent printing medium protruding from said storing portion in accordance with said second unit feeding a preceding printing medium prior to said subsequent printing medium; and a feeding control unit that determines a timing of starting the feeding of said subsequent printing medium according to said timing of said preceding printing medium reaching said predetermined position detected by said timing detection unit and said positional information of said leading end of said subsequent printing medium detected by said position detection unit.

9. A medium feeding device comprising:

a storing portion in which a plurality of sheet-shaped printing media are stored;

a first feeding unit capable of feeding one printing medium after another from said printing media stored in said storing portion to the outside of said storing portion;

a second feeding unit that further feeds said printing medium, having been fed by said first feeding unit, along a predetermined feeding path;

a timing detection unit that detects a timing when said printing medium reaches a predetermined position along said feeding path;

a protruding amount detection unit that detects a protruding amount of a subsequent printing medium protruding from said storing portion in accordance with said second unit feeding a preceding printing medium prior to said subsequent printing medium; and a feeding control unit that determined a timing of starting the feeding of said subsequent printing medium according to said timing of said preceding printing medium reaching said predetermined position detected by said timing detection unit and said protruding amount of said subsequent printing medium detected by said protruding amount detection unit.

10. A medium feeding device comprising:

a storing portion in which a plurality of sheet-shaped printing media are stored;

a first feeding unit capable of feeding one printing medium after another from said printing media stored in said storing portion to the outside of said storing portion;

a second feeding unit that further feeds said printing medium, having been fed by said first feeding unit, along a predetermined feeding path;

a timing detection unit that detects a timing when said printing medium reaches a predetermined position along said feeding path;

a positional information detection unit that detects a positional information of a leading end of said subsequent printing medium protruding from said storing portion in accordance with said second unit feeding a preceding printing medium prior to said subsequent printing medium; and a feeding control unit that determines a timing of starting the feeding of said subsequent printing medium according to said timing of said preceding printing medium reaching said predetermined position detected by said timing detection unit and said positional information of said leading end of said subsequent printing medium detected by said position detection unit.

* * * * *